US009428198B2

(12) United States Patent
Camp et al.

(10) Patent No.: US 9,428,198 B2
(45) Date of Patent: Aug. 30, 2016

(54) MONORAIL VEHICLE APPARATUS WITH GRAVITY-AUGMENTED CONTACT LOAD

(71) Applicant: SOLARCITY CORPORATION, San Mateo, CA (US)

(72) Inventors: John S. Camp, San Francisco, CA (US); Benjamin D. Sumers, Los Altos Hills, CA (US); Ryan P. Feeley, San Francisco, CA (US)

(73) Assignee: SolarCity Corporation, San Mateo, CA (US)

( * ) Notice: Subject to any disclaimer, the term of this patent is extended or adjusted under 35 U.S.C. 154(b) by 0 days.

(21) Appl. No.: 14/951,375

(22) Filed: Nov. 24, 2015

(65) Prior Publication Data

US 2016/0082980 A1 Mar. 24, 2016

Related U.S. Application Data

(63) Continuation of application No. 14/550,960, filed on Nov. 22, 2014, now Pat. No. 9,221,471, which is a continuation-in-part of application No. 13/772,156, filed on Feb. 20, 2013, now Pat. No. 8,939,085.

(51) Int. Cl.
*B61B 13/00* (2006.01)
*B61B 13/06* (2006.01)
*B61B 13/04* (2006.01)

(52) U.S. Cl.
CPC ..... *B61B 13/06* (2013.01); *B61B 13/04* (2013.01)

(58) Field of Classification Search
CPC ..... B61B 13/04
USPC ..... 104/118–125; 105/141–147
See application file for complete search history.

(56) References Cited

U.S. PATENT DOCUMENTS 3,625,158 A * 12/1971 Lorenz ..... B61B 13/04 104/110
3,935,822 A * 2/1976 Kaufmann ..... B61C 13/04 104/109
4,044,688 A * 8/1977 Kita ..... B61C 13/04 104/118
4,185,562 A * 1/1980 Hatori ..... B61B 7/06 104/110
4,690,064 A * 9/1987 Owen ..... B61B 1/02 104/119
5,069,141 A * 12/1991 Ohara ..... B61C 15/02 104/93
5,231,933 A * 8/1993 DiRosa ..... E01B 25/24 104/93
5,372,072 A * 12/1994 Hamy ..... B61B 13/04 104/119
5,479,862 A * 1/1996 Waterkamp ..... B61B 3/02 104/243

(Continued)

*Primary Examiner* — Jason C Smith
(74) *Attorney, Agent, or Firm* — Kilpatrick Townsend & Stockton LLP

(57) ABSTRACT

Apparatus and method for gravity-augmented preload of drive wheels in a monorail vehicle travelling along a guide rail with bearing and contact surfaces that are non-parallel with the gravity vector. The vehicle defines a pivot location against the bearing surface and a constraint point on the contact surface for engaging the rail on the bearing and contact surfaces, respectively. The vehicle is mounted so its center of gravity is at a rear longitudinal offset $r_{rl}$ from the pivot location and a vertical offset $r_{vert}$ from the guide rail. A force and moment balance thus created result in a normal load on a drive wheel engaged with the bearing surface at the pivot location, where the load value exceeds a standard normal load generated by the mass of the monorail vehicle alone.

24 Claims, 12 Drawing Sheets

(56) References Cited

U.S. PATENT DOCUMENTS 5,967,265 A * 10/1999 Bruno ..... B66B 9/0838 187/201
6,178,891 B1 * 1/2001 Ostholt ..... B61C 13/04 104/89
6,321,657 B1 * 11/2001 Owen ..... B61B 1/02 104/119
6,666,147 B1 * 12/2003 Minges ..... B61B 7/06 104/128
7,341,004 B2 * 3/2008 Sullivan, II ..... B61B 13/04 104/118
7,380,507 B2 * 6/2008 Sullivan, II ..... B61B 13/04 104/118
7,650,843 B2 * 1/2010 Minges ..... B61B 7/06 104/178
8,082,853 B2 * 12/2011 Heil ..... B61B 9/00 104/112
2001/0022147 A1 * 9/2001 Hara ..... B61C 13/00 105/141
2006/0213387 A1 * 9/2006 Sullivan ..... B61B 13/04 104/118
2009/0266268 A1 * 10/2009 Timan ..... B61B 13/04 105/157.1
2010/0031845 A1 * 2/2010 Cardoni ..... B66F 9/07559 104/118
2014/0174315 A1 * 6/2014 Camp ..... B61B 13/04 104/118
2014/0230686 A1 * 8/2014 Camp ..... B61B 13/04 104/118
2015/0298708 A1 * 10/2015 Camp ..... B61B 13/04 104/120

* cited by examiner

MONORAIL VEHICLE APPARATUS WITH GRAVITY-AUGMENTED CONTACT LOAD

RELATED APPLICATIONS

This application is a continuation of presently allowed, U.S. patent application Ser. No. 14/550,960 filed on Nov. 22, 2014 which is a continuation-in-part of U.S. patent application Ser. No. 13/772,156 filed on Feb. 20, 2013 now U.S. Pat. No. 8,939,085. Each of these applications is incorporated herein in its entirety.

FIELD OF THE INVENTION

This application is related to monorail vehicle apparatus and methods for augmenting the normal load in monorail vehicles, and more precisely to augmenting the load between the drive wheel of such monorail vehicle and the traction surface through appropriate placement of the center of gravity of the monorail vehicle.

BACKGROUND ART

There are many types of vehicles designed to travel on several or on just one guide rail. Typically, such vehicles have one or more drive wheels that propel them along the guide rail. To accomplish this, a certain amount of torque has to be applied to the drive wheel or wheels engaged with the rail by a drive mechanism. In this way the state of motion of the vehicle can be controlled, e.g., motion at constant velocity or rapid acceleration as required by the application.

The drive force that is delivered by any drive wheels engaged with a guide rail is limited by traction. Consequently, since acceleration requires a certain amount of drive force and faster acceleration requires more force, the permissible acceleration is limited by traction. In many situations the drive force is applied by one traction wheel while others are provided for stability and control (e.g., idler wheels). Therefore it is usually the friction between the drive wheel and the bearing surface of the rail on which the drive wheel rolls that presents the limiting factor on maximum available drive force.

In a general configuration, for instance in a car, the center of gravity is balanced between the vehicle's wheels. A number of solutions exist to increase the normal contact load on traction wheels in such cases, including foils and springs. In fact, the prior art teaches that these solutions can also be applied in vehicles traveling on guide rails, including monorail vehicles traveling along just one rail.

For example, U.S. Pat. No. 5,069,141 to Ohara et al. discloses an overhead conveyor that provides increased reactive force and traction to a drive wheel on ascending rail sections. The conveyor engages the upper side of the track or rail. Its various means for creating a reactive force are positioned to engage the underside of the track to improve frictional forces during ascendancy. More precisely, the weight of the unit is employed to create the reactional force while guide rollers are resiliently biased by either separate springs or by making the guide rollers themselves resilient. Ohara's teachings are applicable to monorail type conveyors that convey articles along a path defined by the guide rail.

Another solution to monorail vehicles addressing stability and hill climbing capability with the aid of springs can be found in the teachings of U.S. Pat. No. 4,044,688 to Kita. Here a monorail transport apparatus travels while holding the monorail from above and below and uses a driving belt in conjunction with an auxiliary wheel. The apparatus deploys a compression spring to accomplish the intended objectives including increased traveling stability irrespective of the sinuousity of the monorail.

Still other solutions use hydraulics. For example, U.S. Pat. No. 5,372,072 to Hamy teaches a transportation system in which the vehicle is coupled to a track by a bogie whose wheels are mounted on mutually articulated frames. These frames are forcibly urged to pivot with the aid of hydraulic rams. In other words, Hamy teaches to achieve wheel contact load, and consequently maximum driving force, with the aid of certain types of hydraulics.

In contrast to the above references, some prior art solutions teach acting on the wheels of monorail vehicles without the use of springs or hydraulic elements. Rather, they teach to take advantage of the vehicle's own weight. For example, U.S. Pat. No. 3,935,822 to Kaufmann teaches a monorail trolley designed to travel on a monorail and having a truck in which the center of gravity of both the loaded and empty trolley truck is displaced with respect to the points of contact between the rail and the supporting wheel and the counter-wheel. This causes both wheels to engage firmly and adhere to the rail. Kaufmann's design accommodates rapid and easy placement of the truck on the monorail and permits the trolley to move up and down grades. He also teaches adjustments in the placement of the center of gravity without the use of springs or hydraulics.

There are many other prior art teachings that use the center of gravity of a monorail vehicle to achieve their objectives. The reader is referred here to U.S. Pat. Nos. 4,690,064 and 6,321,657 both to Owen as well as U.S. Pat. No. 7,650,843 to Minges and the many additional references cited therein.

Unfortunately, none of the prior art teachings, whether using springs, hydraulic elements or just the placement of the vehicle's center of mass are compatible with large increases in contact load on drive wheels of monorail vehicles that are light, low-cost and yet provide for periods of rapid acceleration along the guide rail as the vehicle transports itself between docking stations. Furthermore, the prior art does not address monorail vehicles that exhibit such desirable features and performance characteristics while being confined to travel along a low-grade (e.g., stock) rail that exhibits a substantial profile variation.

OBJECTS OF THE INVENTION

In view of the prior art limitations, it is an object of the invention to provide for monorail vehicle apparatus and methods that permit high accelerations by a monorail vehicle that is light and low-cost. More precisely, it is an object of the invention to reach these objectives by providing a constraint point with idler wheels to prevent lift-off while increasing the load on the drive wheel not only by the mass of the vehicle itself, but also by a moment established about a pivot point.

It is another object of the invention to provide for monorail vehicles and method that achieve such increased drive wheel loads without the use of additional springs or hydraulic elements, thus allowing the vehicle to be light weight and low-cost.

Still other objects and advantages of the invention will become apparent upon reading the detailed description in conjunction with the drawing figures.

SUMMARY OF THE INVENTION

Several advantageous aspects of the invention are secured by a monorail vehicle apparatus with a gravity-augmented normal load on a drive wheel. This goal is achieved by a judicious placement of a center of gravity of a monorail vehicle belonging to the apparatus.

The apparatus has a rail with a bearing surface and a contact surface that are non-parallel to the gravity vector. The vehicle has a structure that defines a pivot location against the bearing surface of the guide rail. Furthermore, the vehicle engages with the rail on the bearing surface and the contact surface.

In accordance with the invention, the monorail vehicle is mounted on the rail such that its center of gravity has a rear longitudinal offset $r_{rl}$ from the pivot location. The center of gravity produces a moment $N_{ap}$ about the pivot location. This moment $N_{ap}$ is resisted by the contact force with the contact surface of the monorail vehicle at a constraint point on the contact surface. The constraint point is located at a front longitudinal offset $r_{fl}$ from the pivot location. Since the contact surface is not parallel to the gravity vector, the contact force adds to the forces resisted by the monorail vehicle on the bearing surface. In other words, the moment $N_{ap}$ contributes to the load on any actual engagement element of the monorail vehicle, e.g., the drive wheel engaged with the bearing surface of the rail at the pivot location. The value of the resultant normal load is typically much beyond a standard load generated by the mass of the monorail vehicle alone.

It should be noted that the force amplification of normal load on the drive wheel is not affected by which end of the monorail vehicle is designated as front and rear. The rear offset of the center of gravity described above is merely a choice made for purposes of the description. Anyone skilled in the art will recognize that front and rear can be swapped in any embodiment according to the invention.

In the preferred embodiment, the monorail vehicle has at least one wheel to move along the rail. Preferably, the vehicle has drive wheel engaged with the bearing surface for propelling the monorail vehicle along the rail. In this preferred embodiment, the vehicle has one or more idler wheels that engage the contact surface of the rail. Alternatively, both the vehicle has drive wheels for propelling the monorail vehicle along both the bearing and contact surfaces of the rail. In still other embodiments, the wheel engaged with the bearing surface can be an idler wheel and the wheel engaged with the contact surface can be a drive wheel.

In addition to rear longitudinal offset $r_{rl}$ from the pivot location, the center of gravity can have a lateral offset $r_{lat}$ defined from a rail centerline along which the rail extends. Similarly, the center of gravity can have a vertical offset $r_{vert}$ from the rail centerline.

The vertical offset $r_{vert}$ can be selected to achieve a number of performance requirements. For instance, if vertical offset $r_{vert}$ is negative, i.e., it defines a location below the pivot point, the monorail vehicle will be more resistant to losing contact in spite of imposed displacements or external forces. Additionally, especially for a vehicle that frequently accelerates or decelerates, a nonzero $r_{vert}$ will increase or decrease the loads on certain wheels depending on vehicle motion. It will also allow the peak traction to be tuned for acceleration or for braking, as the application demands. For example, a negative $r_{vert}$ will result in higher normal loads and more available traction when the vehicle is slowing down than when it is accelerating; this may be desirable in some applications.

In many cases the bearing surface and the constraint surface of the rail are geometrically opposite each other, e.g., they are the top and bottom surfaces of the rail for square and rectangular cross-sections. Furthermore, in order to ensure proper localization of the monorail vehicle an alignment datum can be provided for locating the bogie at any of the docking locations along the rail.

Some applications extend to methods for propelling the monorail vehicle along the rail with increased drive wheel normal load. That goal is accomplished by properly mounting the vehicle on the rail to augment the preload through the placement of the vehicle's center of gravity. In certain embodiments, the rail can be non-featured and have a certain cross-section defined along a rail centerline (parallel with the X-axis or longitudinal axis).

The elements of the apparatus and steps of the methods claimed by the invention do not necessarily require assemblies with wheels to engage with the rail. As such in certain embodiments, the monorail vehicle may just have a hollow cross-section to slide over the guide rail within the spirit of the invention. Additionally, such an embodiment may encapsulate a drive wheel on the bearing surface to define a pivot point and idler wheel or wheels on the contact surface to define a constraint point according to the teachings. Yet, other variations may just have protuberances on the vehicle that make contact with the rail to define a pivot point on the bearing surface and a constraint point on the contact surface.

The details of the invention, including its preferred embodiments, are presented in the below detailed description with reference to the appended drawing figures.

BRIEF DESCRIPTION OF THE DRAWING FIGURES

DETAILED DESCRIPTION

The figures and the following descriptions relate to preferred embodiments of the present invention by way of illustration only. It should be noted that alternative embodiments of the structures and methods disclosed herein will be readily recognized as viable options that can be employed without departing from the principles of the claimed invention.

Reference will now be made to several embodiments of the present invention, examples of which are illustrated in the accompanying figures. Similar or like reference numbers are used to indicate similar or like functionality wherever practicable. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
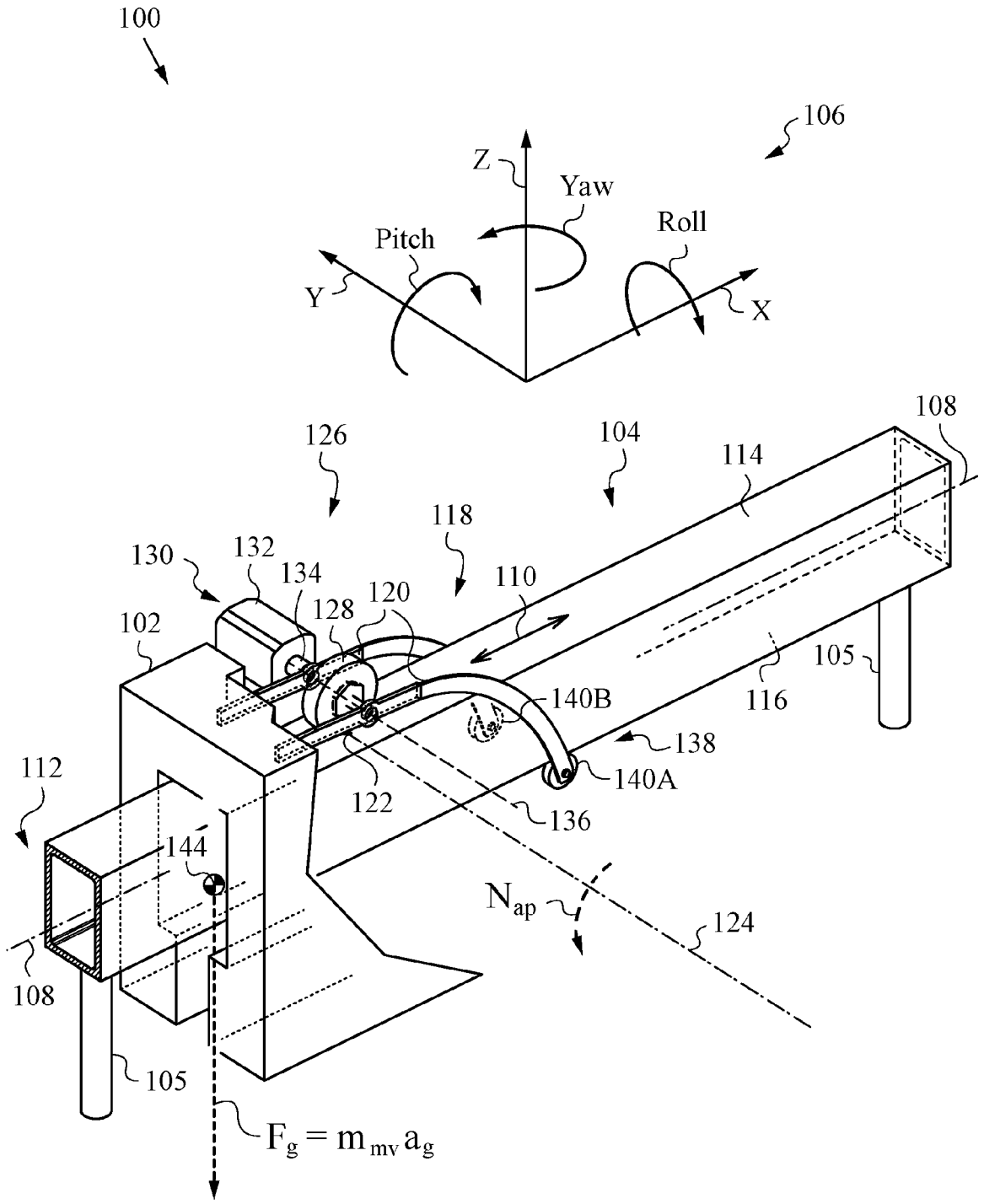
FIG. 1 is a partial isometric view of a monorail vehicle apparatus according to the invention.

The present invention will be best understood by first reviewing the embodiment of a monorail vehicle apparatus 100 as shown in the isometric view afforded by FIG. 1. A monorail vehicle 102 belonging to apparatus 100 travels along a non-featured rail 104 that is supported on one or more posts or mechanical supports 105. To understand the mechanics of the travel of monorail vehicle 102 we first review the definitions of relevant parameters in an appropriate coordinate system 106. We also note that monorail vehicle 102 is not shown in full in FIG. 1. In fact, a substantial portion of monorail vehicle 102 is cut-away in this view for clarity.

It is convenient that coordinate system 106 be Cartesian with its X-axis, also referred to as the longitudinal axis by some skilled artisans, being parallel to a rail centerline 108 along which non-featured rail 104 extends. Both, rail centerline 108 and X-axis are also parallel to a displacement arrow 110 indicating the possible directions of travel of monorail vehicle 102. It should be noted that arrow 110 shows that vehicle 102 can travel in either direction. In other words, vehicle 102 can travel in the positive or negative direction along the X-axis as defined in coordinate system 106. Furthermore, coordinate system 106 is right-handed, and its Y- and Z-axes define a plane orthogonal to the direction of travel of vehicle 102.

In addition to linear movement along any combination of the three axes (X,Y,Z) defined by coordinate system 106, monorail vehicle 102 can also rotate. A total of three rotations are available to vehicle 102, namely about X-axis, about Y-axis and about Z-axis. These rotations are indicated explicitly in FIG. 1 by their corresponding names, specifically: roll, pitch and yaw. Although many conventions exist for defining three non-commuting rotations available to rigid bodies in three-dimensional space, the present one agrees with conventions familiar to those skilled in the art of mechanical engineering of suspensions.

In total, monorail vehicle 102 thus has six degrees of freedom; three translational ones along the directions defined by the axes (X,Y,Z) and three rotational ones (roll, pitch, yaw). The translational degrees of freedom are also referred to in the art as longitudinal translation along rail 104 (X-axis), lateral translation (Y-axis) and vertical translation (Z-axis).

Non-featured rail 104 has a rectangular cross-section 112. Furthermore, top surface 114 of rail 104 is chosen to be the bearing surface and the geometrically opposite bottom surface 116 of rail 104 is chosen to be the contact surface. Note that bearing surface 114 and contact surface 116 are non-parallel, and indeed orthogonal (perpendicular) to a vector $F_g$ denoting the force of gravity acting on monorail vehicle 102.

Monorail vehicle 102 engages rail 104 such that it can travel along rail 104 in either direction, as already indicated by arrow 110. The vehicle has a structure 118 that defines a pivot location 220 against bearing surface 114 of rail 104. An axis through pivot location 122 and perpendicular to the X-Z plane can be used to sum the moments about pivot location 122. In fact, such a pitch axis 124 through pivot location 122 is drawn in FIG. 1 for clarity.

The monorail vehicle 102 includes a first assembly 126 for engaging rail 104 at pivot location 122. First assembly 126 can have any number of first assembly wheels to engage rail 104. In the present embodiment, first assembly 126 has just one wheel 128, which is also a drive wheel that engages rail 104 on bearing surface 114. Drive wheel 128 is connected to a drive mechanism 130 for moving or displacing vehicle 102 along rail 104 in either direction along the X-axis, as also indicated by displacement arrow 110.

Although a person skilled in the art will recognize that any suitable drive mechanism 130 may be used, the present embodiment deploys a motor 132 with a shaft 134 on which drive wheel 128 is mounted. Thus, motor 132 can apply a corresponding torque to rotate shaft 134 about a rotation axis 136 and thereby drive wheel 128 that is engaged with top or bearing surface 114 of rail 104. In this manner, motor 132 can use drive wheel 128 to propel vehicle 102 along the positive or negative longitudinal direction as defined by the X-axis of coordinate system 106.

Further, the monorail vehicle 102 has a second assembly 138 for engaging rail 104 on its contact surface 116. Second assembly 138 is designed to engage on contact surface 116 in such a way that it produces a contact force $F_c$, explained in more detail in reference to FIG. 2, at a front longitudinal offset $r_{fl}$ from pivot location 122. More precisely, second assembly 138 engages contact surface with two second assembly wheels 140A, 140B that are constrained directly by contact surface 116 to prevent bogie 118 from pivoting about pitch axis 124.

Figure 2:
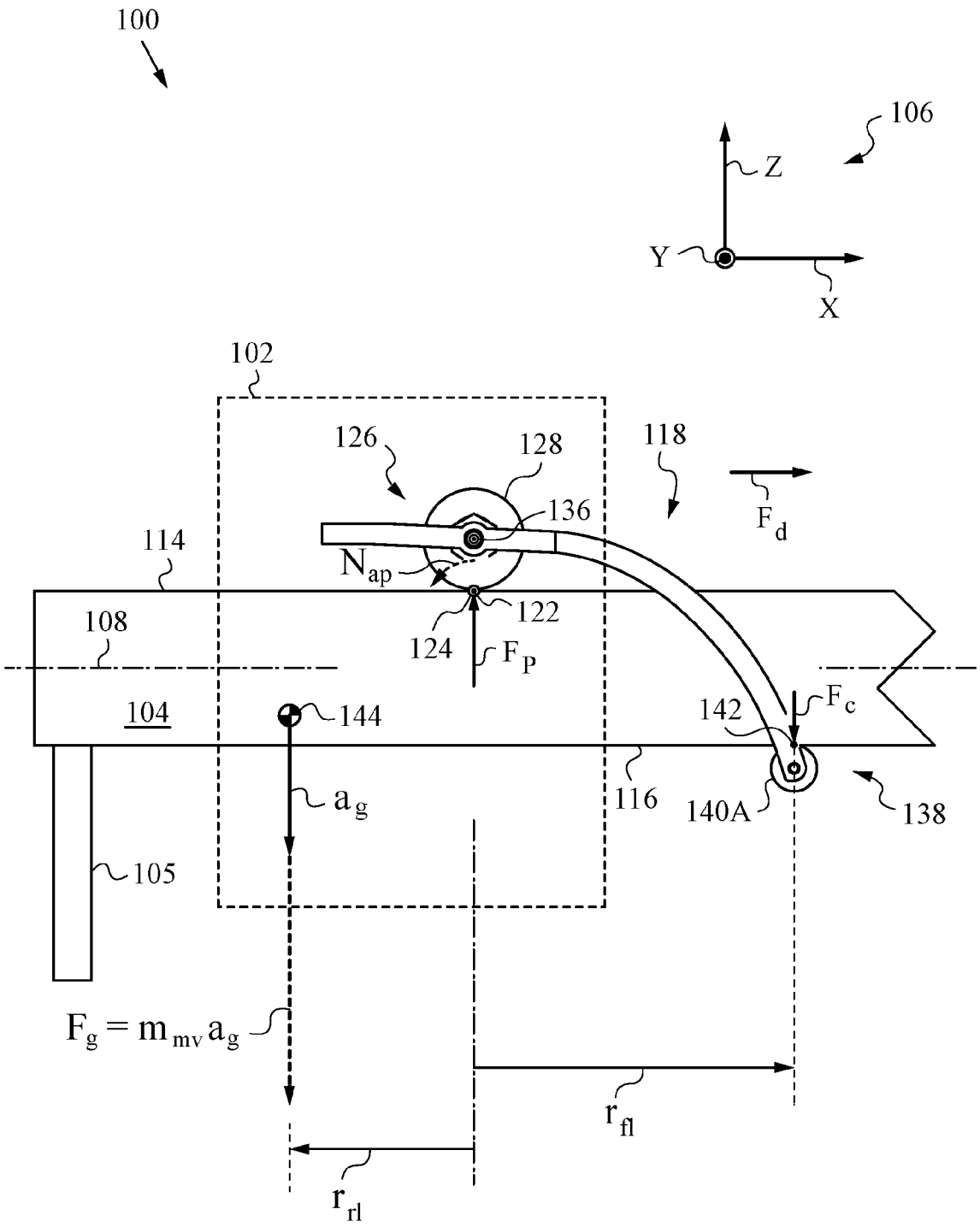
FIG. 2 is a partial elevation view of the monorail vehicle apparatus of FIG. 1 showing the pivot location and lift-off constraint on the rail that supports the monorail vehicle.

We now refer to FIG. 2 where monorail vehicle apparatus 100 is shown in a partial elevation view. Here, pivot location 122 and contact force $F_c$ against bottom or contact surface 116 of rail 104 are shown explicitly. More precisely, contact force $F_c$ obtains a constraint point 142 between idler wheels 140A, 140B (note that only idler wheel 140A is visible in FIG. 2) of second assembly 138 and contact surface 116 at front longitudinal offset $r_{fl}$ from pivot location 122.

In accordance with the invention, monorail vehicle 102 is designed for producing a gravity-augmented normal load on drive wheel 128 and on idler wheels 140A, 140B. This objective is achieved by a judicious placement of a center of gravity 144 of vehicle 102. Specifically, vehicle 102 has its center of gravity 144 offset longitudinally by $r_{rl}$ from pivot location 122. Such placement of center of gravity 144 produces a moment $N_{ap}$ about pivot location 122 or rather about pitch axis 124 and thus generates the desired gravity-augmented preload at pivot location 122 and at constraint point 142. As the value of rear longitudinal offset $r_{rl}$ increases, the normal load can be increased much beyond a standard normal load generated by the mass of monorail vehicle 102 alone.

We now motivate the requirement for a large normal load $F_p$ that is generated in accordance with the invention. $F_p$ is a force parallel with gravity vector $F_g$ shown acting on center of gravity 144. Furthermore, the force of normal load $F_p$ is experienced by drive wheel 128 of first assembly 126. As the mass of monorail vehicle 102 increases, a drive force $F_d$ (indicated by its vector in FIG. 2) needed to accelerate it increases proportionately. Under ideal conditions, based on Newton's Second Law, the acceleration $a_{mv}$ of monorail vehicle 102 of mass $m_{mv}$ achieved by the application of drive force $F_d$ would be given by:

$$a_{mv} = \frac{F_d}{m_{mv}} \quad \text{(Eq. 1)}$$

In practice, however, rolling friction μ places an upper limit on drive force $F_d$ that can be applied to a drive wheel. That is because the available drive force $F_d$ is limited by the force of friction $F_r$ at impending slip between drive wheel 128 and rail 114, and more precisely between drive wheel 128 and bearing surface 114. The maximum drive force $F_{dmax}$ for a prior art vehicle on a horizontal guide rail in which no moment $N_{ap}$ is used for increasing normal load is thus limited to:

$$F_r = F_{dmax} = \mu m_{mv} a_g \quad \text{(Eq. 2)}$$

where $a_g$ is the Earth's gravitational acceleration that produces a downward force on any drive wheel. Consequently, when wishing to apply a large drive force $F_d$, the selection of materials for prior art drive wheels becomes limited to high-friction substances to obtain a high coefficient of rolling friction μ. Unfortunately, high-friction substances frequently have the undesirable properties of high wear, high rolling friction, adhesion and high deformation. Typical prior art solutions involve the use of foils and springs to increase the load on the traction wheel. Such solutions are dependent on vehicle dynamics or require additional mechanisms that add weight and complexity to the vehicle.

We now present the mathematical expressions that demonstrate the relationship between the location of center of gravity 144 of vehicle 102 and its static and dynamic behavior. We start by defining a reference frame that travels with vehicle 102 and has its origin at pivot location 122. For simplicity, we adopt the following conventions to allow several vector quantities to be treated as scalars by taking the three-degree-of-freedom equations of motion and constraining them to motion along rail 104; this simplifies their unit directions a priori. Thus, vectors $a_g$, $F_g$, $F_p$ and $N_{ap}$ are assumed to have the directions shown in FIG. 1 and will be treated as scalars. Negative values indicate that the direction is opposite of that shown in FIG. 1. Vectors $F_c$ and $r_{fl}$ will be similarly treated using the directions illustrated in FIG. 2. Offset vectors $r_{rl}$, $r_{vert}$ and $r_{lat}$ of center of mass 144 will be treated as scalars by assuming the directions shown in FIG. 3. Lastly, vehicle acceleration vector $a_{mv}$ is assumed to act in the positive x-direction according to coordinate system 106. Without complete mathematical rigor, which will be clear from the context to one skilled in the art, we may use the same symbol to denote either the vector or the scalar quantity.

By placing center of gravity 144 of vehicle 102 at a longitudinal offset $r_{rl}$ from pivot location 122 where drive wheel 128 contacts bearing surface 114, and by providing constrained idler wheels 140A, 140B in second assembly 138 normal load $F_p$ on drive wheel 128 is no longer limited by the mass $m_{mv}$ of vehicle 102. This is shown by simplifying the equations that result from performing a static balance of the forces in the vertical direction and a static moment balance about pitch axis 124 that passes through pivot point 122. It is seen that normal load $F_p$ on drive wheel 128 can be increased by manipulating the value of rear longitudinal offset $r_{rl}$ of center of gravity 144 from pivot location 122. We note that as shown with the orientation of wheels in FIG. 1, it is necessary that $r_{rl}/r_{fl}$ be non-negative so vehicle 102 does not flip off rail 104. A conventional monorail vehicle would have both wheels on top of the rail and $r_{rl}/r_{fl}$ would be non-positive.

To better understand the result of increasing rear longitudinal offset $r_{rl}$, we now review the forces acting on vehicle 102 constructed in accordance with the invention. This means vehicle 102 is travelling in a straight line at a constant velocity on a horizontal section of rail 104. Gravitational force $F_g$ acts on center of gravity 144 of vehicle 102 and is given by:

$$F_g = m_{mv} a_g \quad \text{(Eq. 3)}$$

The vector corresponding to this force is indicated in FIGS. 1 & 2. Normally, load $F_p$ on drive wheel 128 is limited to at most the gravitational force $F_g$, as we saw above. In apparatus 100 of the invention, however, rear longitudinal offset $r_{rl}$ of center of gravity 144 creates moment $N_{ap}$ about pitch axis 124 that is expressed by:

$$N_{ap} = m_{mv} a_g r_{rl} = F_g r_{rl} \quad \text{(Eq. 4)}$$

Under these conditions the value of rear longitudinal offset $r_{rl}$ can be increased to achieve a large moment $N_{ap}$.

With $N_{ap}$ taken into account, we sum the moments around pitch axis 124. The result gives:

$$\text{Sum of the Moments about 124} = (m_{mv} * a_g * r_{rl}) - (F_c * r_{fl})$$

We can solve for contact force $F_c$ on idler wheels 140 at point of contact 142 for the constant velocity case as follows:

$$F_c = \frac{m_{mv} * a_g * r_{rl}}{r_{fl}} \quad \text{(Eq. 5)}$$

With $F_c$ known, we can now sum the forces in the z-direction (along the vertical or Z-axis of coordinate system 106) on vehicle 102. In particular:

$$\text{Sum of the Forces in } Z = F_p - F_c - (m_{mv} * a_g)$$

Setting this sum equal to 0, since vehicle 102 is not free to translate along Z-axis and solving for load $F_p$ on drive wheel 128 we obtain:

$$F_P = m_{mv} * a_g * \left(1 + \frac{r_{rl}}{r_{fl}}\right). \quad \text{(Eq. 6)}$$

The loading on drive wheel 128 is governed by the factor of $$1 + \frac{r_{rl}}{r_{fl}},$$

and since $$\frac{r_{rl}}{r_{fl}}$$

is nonnegative, this factor is clearly greater than one. This permits increasing the normal force $F_p$ on the drive wheel 128 to a theoretically arbitrary limit. It will be clear to a skilled artisan that suitable modifications to these expressions using trigonometric relations allow this analysis to be generalized to a guide rail having a non-zero inclination angle (non-horizontal rail).

In practice, the normal load $F_p$ on drive wheel 128 is limited by a number of factors. First, moment $N_{ap}$ produces stresses in vehicle 102 that require management. Additionally, a large normal load $F_D$ can produce high rolling friction, increased wear and high deformation of drive wheel 128. A person skilled in the art will understand the trade-offs between these loads and the advantages of loading drive wheel 128.

Second, front longitudinal offset $r_{fl}$ is limited by requirements on the performance of monorail vehicle 102. Many vehicles must retain accurate location while resisting wear. The pitching of vehicle 102 on bearing surface 114 of rail 104 caused by the wear of wheels 140A and 140B can be described by:

$$\text{Induced Pitch} = \tan^{-1}\frac{(\Delta\ \text{Wheel}\ \ 104B\ \ \text{radius}}{r_{fl}}$$

Further, the vibrational mode of vehicle 102 in pitch is a function of front longitudinal offset $r_{fl}$. Assuming the pitch stiffness is dominated by the wheel, rather than chassis compliance, a larger $r_{fl}$ will create a stiffer mechanism.

Third, rear longitudinal offset $r_{rl}$ is also limited by requirements on the performance of apparatus 100. By the requirement of apparatus 100, the mass $m_{mv}$ of monorail vehicle 102 is supported by a cantilevered portion of the chassis having of length equal to $r_{rl}$. Vehicle 102 can thus be modeled as a cantilever beam with a mass; with its center of gravity 144 attached to the end of the beam. Vehicular strength and stiffness requirements dictate that $r_{rl}$ cannot be arbitrarily increased.

For example, supposing that wheel compliance is negligible and the vehicle chassis is modeled as a compliant beam of uniform cross-section. The natural frequency of apparatus 100, and in particular of vehicle 102 mounted on rail 104 can then be calculated as:

$$\omega_{nat} = \sqrt{\frac{3*E*I}{r_{rl}^2*(r_{rl}+r_{fl})*m_{mv}}}$$

Where E is the Young's Modulus of the structure of vehicle 102 and I is the area moment of inertia of the structure of the vehicle 102. We therefore see that, for a given structural cross-section, $r_{rl}$ is limited by a minimum natural frequency of the mechanical system represented by vehicle 102 mounted on rail 104 and cannot be arbitrarily increased.

Figure 3:
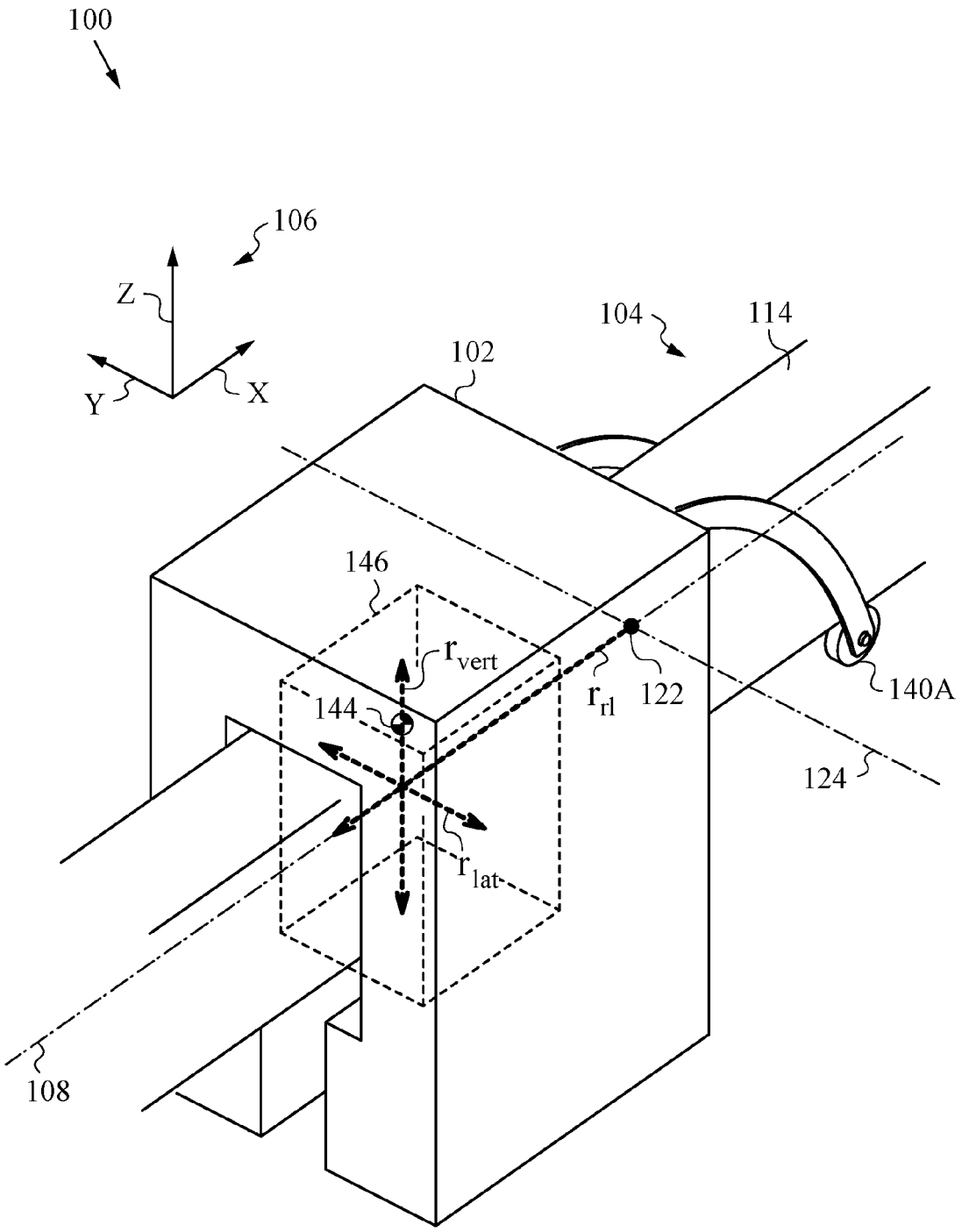
FIG. 3 is a partial isometric view of the monorail vehicle apparatus of FIG. 1 illustrating the degrees of freedom in the placement of the center of gravity of the monorail vehicle.

FIG. 3 is a partial isometric view of monorail vehicle apparatus 100 that illustrates the full freedom in the placement of center of gravity 144 of vehicle 102 within a volume 146. In this drawing we see that in addition to rear longitudinal offset $r_{rl}$ from pivot location 122, center of gravity 144 can have a lateral offset $r_{lat}$ in the Y-Z plane along the Y-axis as defined in coordinate system 106. Lateral offset $r_{lat}$ is defined from rail centerline 108 along which rail 104 extends. This degree of freedom in the placement of center of gravity 144 can be useful when vehicle 102 is not symmetric in its lateral weight distribution and for other engineering reasons.

Similarly, center of gravity 144 can have a vertical offset $r_{vert}$ from rail centerline 108. Vertical offset $r_{vert}$ is also in the Y-Z plane and along the Z-axis as defined in coordinate system 106. Vertical offset $r_{vert}$ is defined from pivot location 122.

In principle, vertical offset $r_{vert}$ can be set above rail centerline 108 or below it. With vertical offset $r_{vert}$ above rail centerline 108 (direction shown in FIG. 3, and thus a positive scalar value), a displacement of center of gravity 144 in roll will create a contributing moment that exacerbates the displacement. By contrast, with $r_{vert}$ set below pivot 122, displacement of center of gravity 144 in roll will create an opposing moment. Any lateral or longitudinal forces, such as centrifugal forces due to centripetal acceleration $a_c$ when monorail vehicle 102 travels along a curve in rail 104 will tend to displace center of gravity 144.

In this application, $r_{vert}$ has additional implications. The above example of loads at pivot location 122 where drive wheel 128 contacts bearing surface 114 assumed constant velocity. With acceleration in a straight path included, and using D'Alembert's Principle of inertial forces to perform force and moment balances that sum to zero, the term for moment $N_{ap}$ is different, namely:

$$\text{Sum of the Moments}=N_{ap}-(F_c*r_{fl})=0$$

where:

$$N_{ap}=m_{mv}*a_g*r_{rl}-m_{mv}*a_{mv}*r_{vert}$$

Following this equation through, the expression for the normal load $F_p$ on drive wheel 128 is:

$$F_P = m_{mv}*a_g*\left(1+\frac{r_{rl}}{r_{fl}}\right)+\frac{m_{mv}*a_{mv}*r_{vert}}{r_{fl}}.$$

It is clear that for $r_{vert}$ set below pivot location 122 (negative scalar according to the vector convention established in FIG. 3), a negative acceleration $a_{mv}$ will produce a larger normal load $F_p$ on drive wheel 128 at pivot location 122 where it contacts rail 104. Alternatively, if $r_{vert}$ is positive, a positive acceleration will produce a larger load $F_p$ on drive wheel 128 at its contact point with rail 104—i.e., at pivot location 122. This is particularly helpful in applications where one direction of agility is more valuable than another. For example, if vehicle 102 must stop much faster than accelerate to achieve certain stopping distances, e.g., in order to comply with safety concerns, selecting a negative $r_{vert}$ will allow vehicle 102 to achieve such short stopping distances without unnecessarily loading drive wheel 128 in normal operation.

For example, for a 50 kg vehicle 102 with a friction coefficient of about 0.3 seeking to achieve about 0.5 g acceleration, drive wheel 128 must be loaded to approximately 735 N (i.e., $F_p$=735 N). With a standard vehicle, these agility parameters would not be achievable as the total available force from the mass of the vehicle is only 500 N. In accordance with the present invention, a designer can then select rear longitudinal offset $r_{rl}$ to be 0.25 m and front longitudinal offset $r_{fl}$ to be 0.5 m. This would correspond to a normal load $F_p$ on drive wheel 128 of 735 N and thus permit vehicle 102 to achieve high agility requirements.

Further, suppose that vehicle 102 exhibiting the above parameters and offsets has to come to a complete stop from a speed of 8 m/s in less than 1 second for safety reasons. This would require an acceleration of 0.81 g and a normal load $F_p$ on drive wheel 128 equal to about 1,200 N. A designer would want to avoid unnecessarily loading drive wheel 128 and could therefore select an $r_{vert}$ so that braking would contribute to normal load $F_p$ on drive wheel 128. In this case, if the designer were to select $r_{vert}$ of −0.6 m, then vehicle 102 would experience a normal force of 1,215 N on drive wheel 218 during braking, ceteris paribus. This permits vehicle 102 to achieve its braking parameters without unduly loading drive wheel 128 in normal operation.

In reviewing monorail vehicle apparatus 100 it is important to note, that since contact force $F_p$ on drive wheel 128 rolling along top bearing surface 114 also benefits from the standard force of weight $m_{mv}a_g$ it is preferable that it roll along top surface 114 rather than bottom contact surface 116. However, given a sufficiently large moment $N_{ap}$, it is possible to provide one or more drive wheels that travel on bottom contact surface 116.

Figure 4:
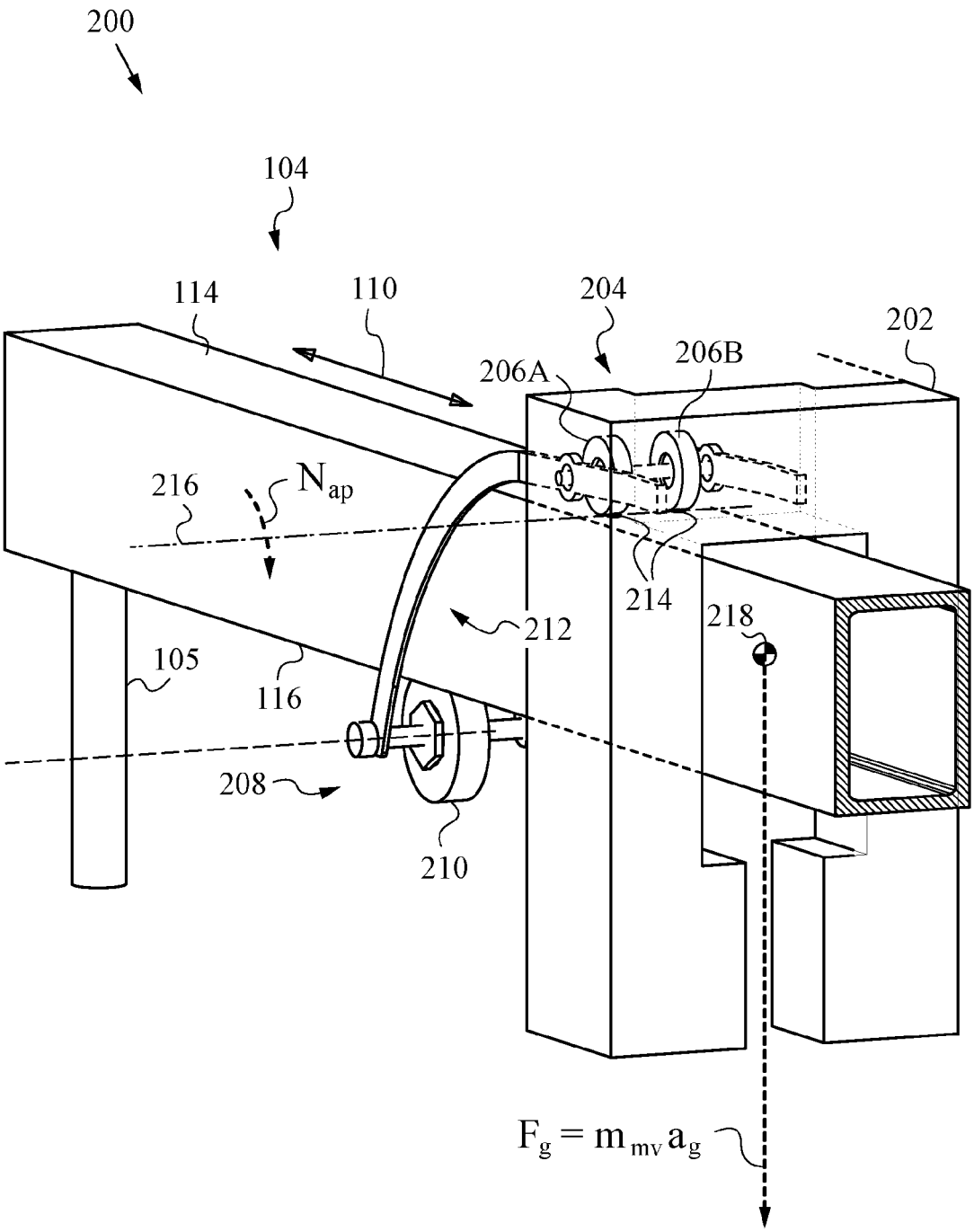
FIG. 4 is a partial isometric view of another monorail vehicle apparatus according to the invention.

FIG. 4 is an isometric view that illustrates a monorail vehicle apparatus 200 in which a monorail vehicle 202 traveling along rail 104 has a first assembly 204 with idler wheels 206A, 206B and a second assembly 208 with a drive wheel 210. The drive mechanism associated with drive wheel 210 is not shown in FIG. 4. Persons skilled in the art will appreciate that a suitable drive mechanism can deploy any known motor. Drive mechanisms with a remote motor mounted in the main body of vehicle 202 and a belt drive for transmitting its torque to drive wheel 210 in order to minimize the mass of second assembly 208 are preferred.

A structure 212 connecting first and second assemblies 204, 208 with the main body of vehicle 202 establishes a pivot location 214 against bearing surface 114 of rail 104. It is at pivot location 214 that idler wheels 206A, 206B belonging to first assembly 204 contact bearing surface 114. More precisely, idler wheels 206A, 206B contact bearing surface 114 along a pitch axis 216 defined through pivot location 214.

Figure 5:
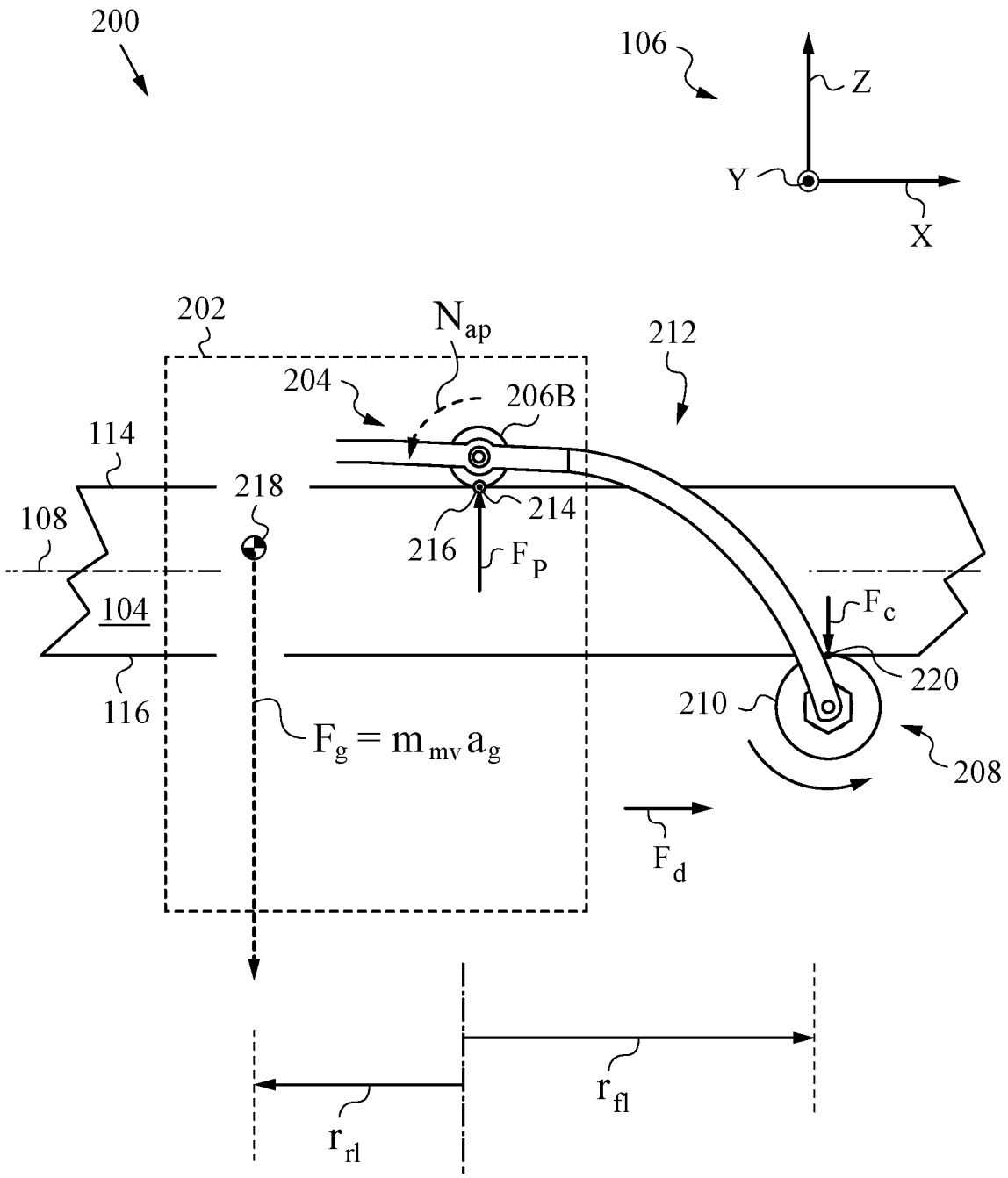
FIG. 5 is a partial elevation view of the monorail vehicle apparatus of FIG. 4 showing the details of application of the drive force by a drive wheel traveling on the contact surface.

Referring now to FIG. 5, which shows a partial elevation view of monorail vehicle 202 of FIG. 4, we see that a moment $N_{ap}$ is created about pitch axis 216 by the placement of center of gravity 218 of vehicle 202 at a rear longitudinal offset $r_{rl}$ from pivot location 214. Meanwhile, drive wheel 210 of second assembly 208 engages with bottom or contact surface 116 of rail 104 at a constraint point 220. Constraint point 220 is located at a front longitudinal offset $r_{fl}$ from pivot location 214.

In this embodiment, load force $F_p$ acts on idler wheels 206 (only idler wheel 206B visible in FIG. 5) at pivot location 214. Contact force $F_c$ acts on drive wheel 210 at constraint point 220. Because contact force $F_c$ is created by moment $N_{ap}$ and is not augmented by the force of weight of vehicle 202, drive force $F_d$ that can be applied to drive wheel 210 in this embodiment is lower than in the preferred embodiment described above. Thus, vehicle 202 will generally not achieve the levels of agility attained by vehicle 102.

In another embodiment, however, vehicle 202 may deploy one or more drive wheels in the place of idler wheels 206A, 206B. Clearly, when using drive wheels engaged with both top surface 114 and bottom surface 116 of rail 104 very high levels of agility can be achieved. In fact, both first and second assemblies 204, 208 can in general use any suitable combination of one or more drive wheels and one or more idler wheels. The idler wheels may include wheels that roll along surfaces of rail 104 other than bearing surface 114 and contact surface 116. For example, idler wheels can be arranged to travel on side surfaces of rail 104 that are generally parallel with the gravity vector.

Figure 6A:
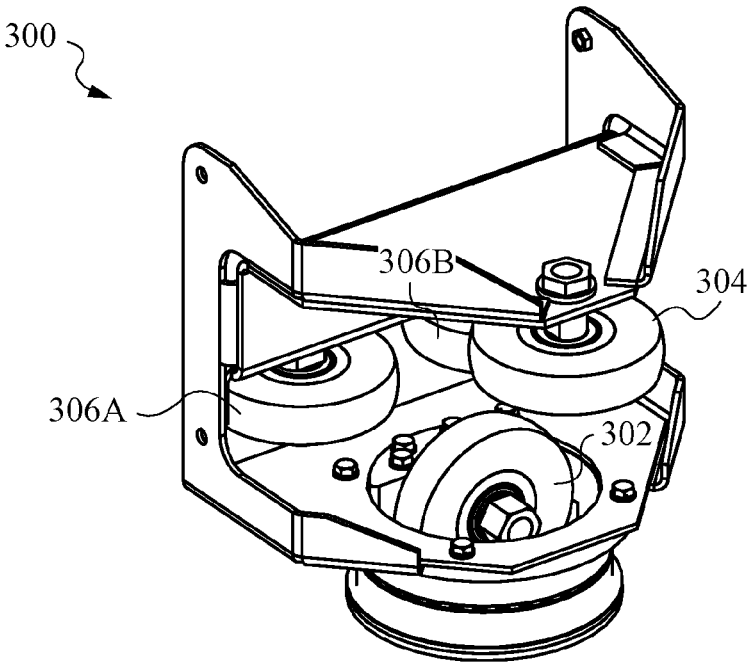
FIG. 6A is an isometric view of a single second assembly equipped with a number of idler wheels.

FIG. 6A is an isometric view of an exemplary second assembly 300 that deploys a single idler wheel 302 for engaging a contact surface of a rail. Assembly 300 also has one idler wheel 304 for engaging one side surface of a rail and two idler wheels 306A, 306B for engaging the other side surface of a rail. In practical applications, assemblies with additional idler wheels are desirable since they help in stabilizing the monorail vehicle and constraining the rotational degrees of freedom (e.g., yaw and roll).

Figure 6B:
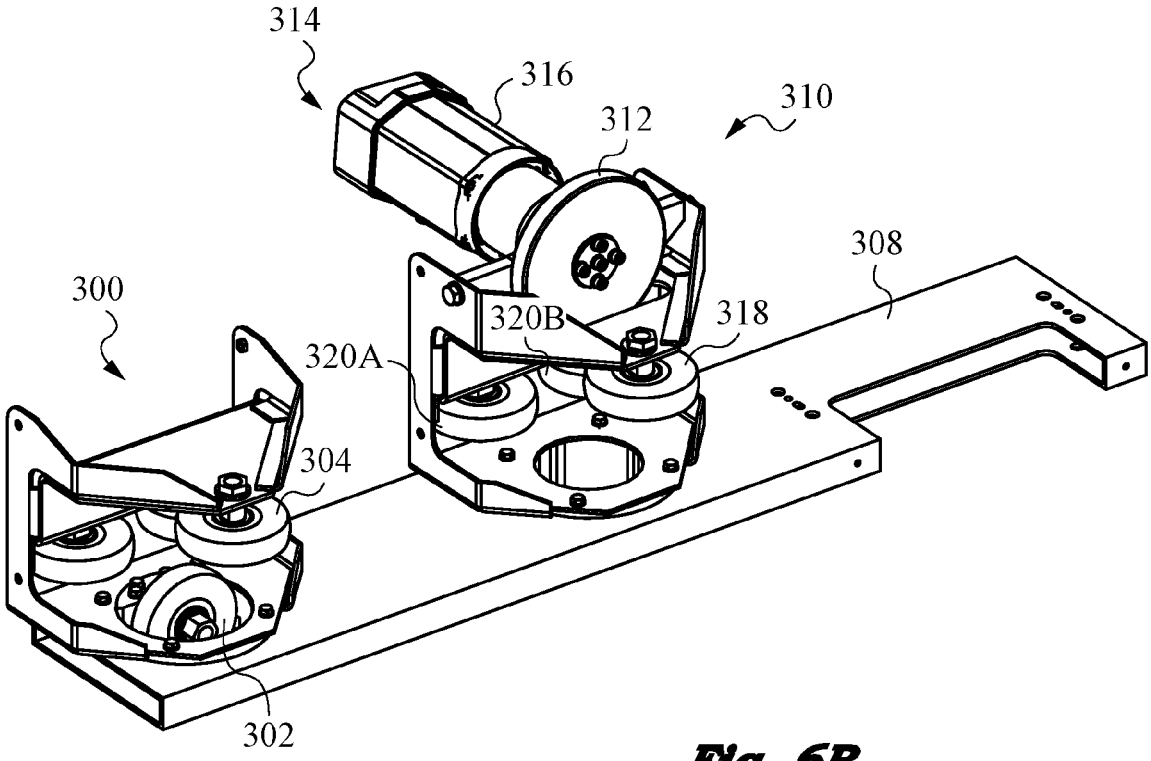
FIG. 6B is an isometric view of a structure deploying the second assembly of FIG. 6A in conjunction with a first assembly also equipped with additional idler wheels.

FIG. 6B is an isometric portion of a structure 308 deploying second assembly 300 in conjunction with a first assembly 310. First assembly 310 has a drive wheel 312 powered by a drive mechanism 314 that includes a motor 316. In addition, first assembly 310 also has one idler wheel 318 for engaging one side surface of a rail and two idler wheels 320A, 320B for engaging the other side surface of a rail.

Figure 6C:
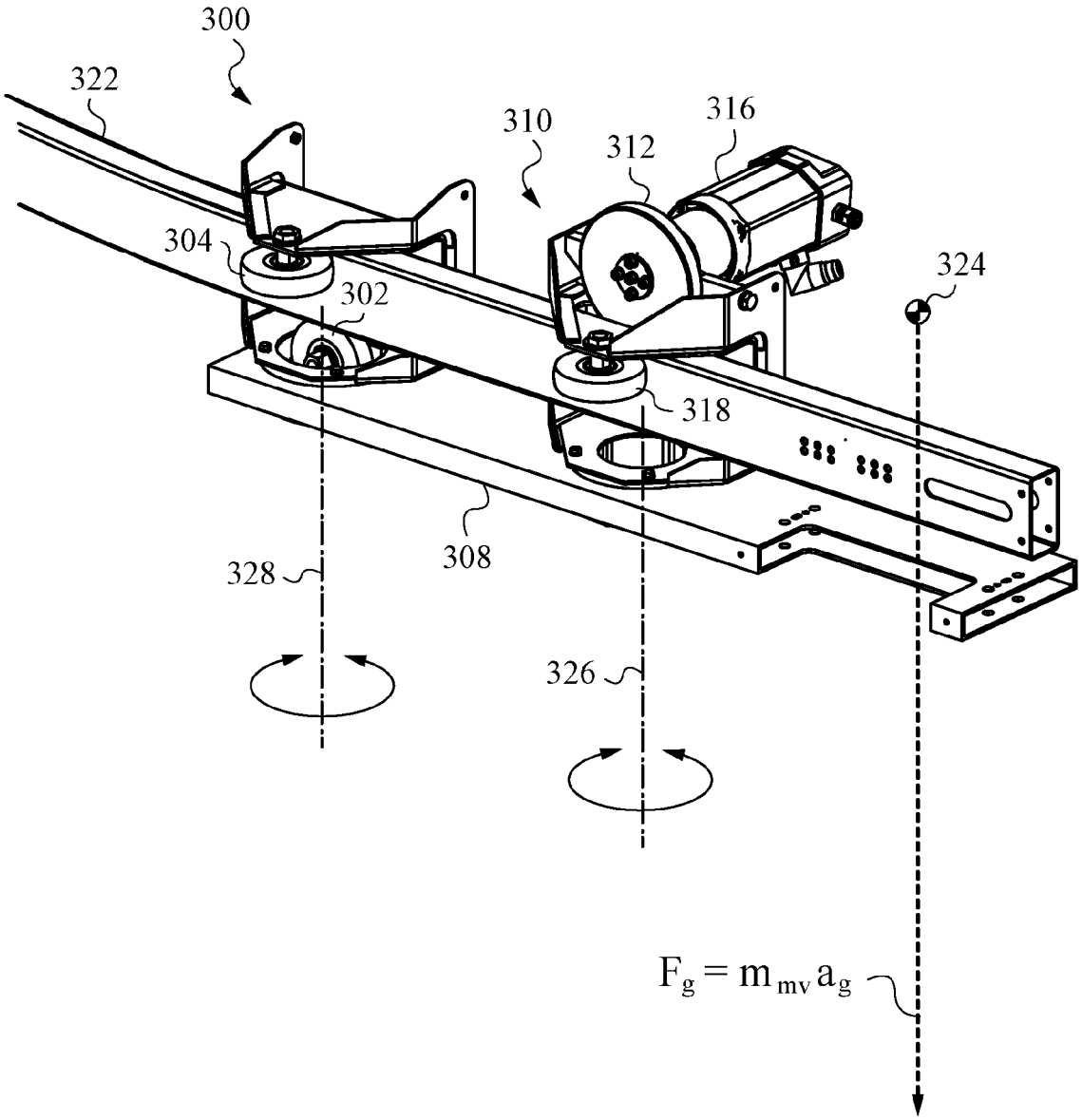
FIG. 6C is an isometric view illustrating how the structure of FIG. 6B is mounted on a guide rail.

FIG. 6C is an isometric view illustrating how structure 308 is mounted on a guide rail 322 that has a rectangular cross-section. Note that drive wheel 312 of first assembly 310 engages against a top surface of rail 322, which is the bearing surface in this case. Idler wheel 302 of second assembly 300 engages against a bottom surface of rail 322, which is the contact surface. The remaining idler wheels of assemblies 300, 310 engage the side surfaces of rail 322 to stabilize any monorail vehicle deploying structure 308.

A center of gravity 324 of such monorail vehicle and its location with respect to assemblies 300, 310 is shown in FIG. 6C for reference. Note that besides the rear longitudinal offset (not expressly shown in FIG. 6C) center of gravity 324 can additionally exhibit a lateral and/or a vertical offset, as previously discussed.

An additional advantageous aspect of the invention involves the manner in which assemblies 300, 310 are mounted on structure 308. Specifically, first assembly 310 and second assembly 300 support mutual rotation to provide for travel of any monorail vehicle using structure 308 along curves in rail 322. Corresponding axes of rotation 326, 328 of first and second assemblies 310, 300 are indicated along with arrows indicating the possible rotations.

Figure 6D:
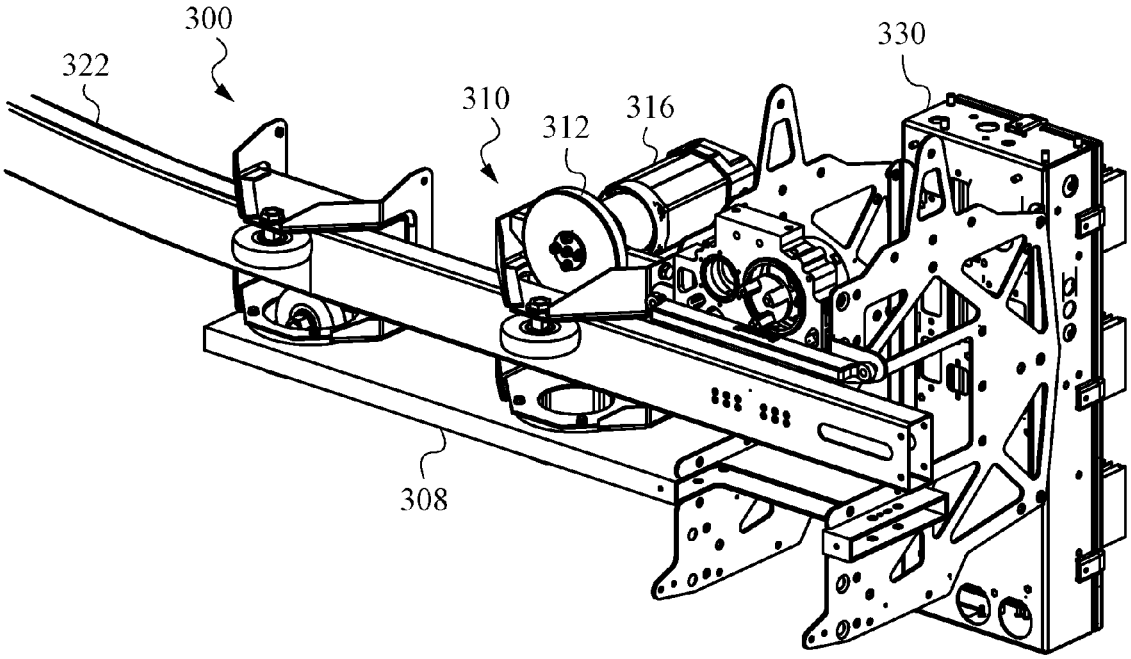
FIG. 6D is an isometric view illustrating mounted structure of FIG. 6C along with a chassis of a monorail vehicle deploying the structure to achieve gravity-augmented drive wheel preload in accordance with the invention.

FIG. 6D is an isometric view illustrating structure 308 attached to a chassis 330 of a monorail vehicle. The cover of monorail vehicle as well as its parts are not expressly shown in FIG. 6D for reasons of clarity. Because of the advantageous design and mutual rotation capability of first and second assemblies 310, 300 the monorail vehicle using structure 308 not only achieves normal load on drive wheel 312 exceeding that obtained by the force of weight alone, but also can move along curves in rail 322 that have a small radius of curvature. The rotation capacity of assemblies 310, 300 allow the monorail vehicle to navigate tight turns having a turning radius at least as small as the wheel base between the two rotating assemblies.

Those skilled in the art will recognize that the shape of curved monorail 322, the manner in which a straight section of rail 322 blends with a turn, and the desired velocity of the monorail vehicle as it navigates through a turn all impact the loads that turning applies to the vehicle. It should also be recognized that provisions must be made to ensure that the rotating assemblies have a stable yaw equilibrium in all operational locations on monorail 322 to keep the assembly aligned with the tangent vector to monorail 322. Among many possible options available to the designer, such stability could be provided by springs that generate a restoring force to bias the assembly to return to center. Another alternative is to incorporate multiple wheels into the rotating assembly to thereby provide alignment of the assembly to the tangent vector of monorail 322.

The apparatus and method of invention are compatible with guide rails that are non-featured and have various cross-sections. In fact, a monorail vehicle with gravity-augmented normal load according to the invention can travel even along a low-grade stock rail that exhibits substantial profile variation.

Figure 7:
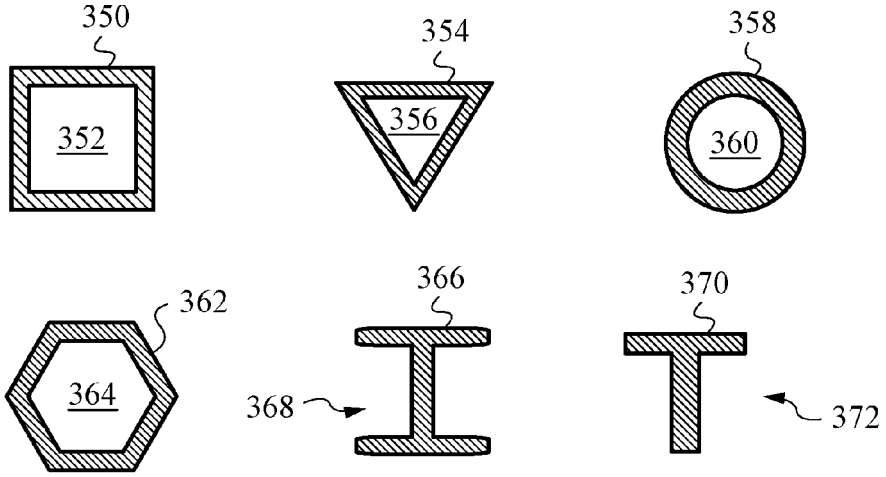
FIG. 7 are cross-sectional views of suitable rails for monorail vehicles and methods of the present invention.

FIG. 7 illustrates several suitable rails and their cross-sections along rail centerlines. Specifically, a rail 350 has a square cross-section 352 and can be used in the same way as previously discussed rails with rectangular cross-sections. Another suitable rail 354 has a rectangular cross-section 356. Note that in the case of rail 354 all side surfaces are non-parallel to the gravity vector when mounted in the orientation shown. Triangular cross-section 356, however, is not widely available and therefore it is desirable to use rectangular cross-section instead.

Another desirable rail 358 with circular cross-section 360 is also shown. Note that in the case of rail 358 additional mechanisms are required to constrain roll about longitudinal axis (X-axis). Still another possible rail 362 has a desirable closed cross-section afforded by its hexagonal cross-section 264. Based on these non-exhaustive examples a person skilled in the art will recognize that there are many other suitable cross-sections that are compatible with the apparatus and methods of the present invention.

FIG. 7 shows in order of decreasing desirability two other possible cross-sections that can be used in non-featured rails deployed in monorail vehicle apparatus of the invention. Specifically, rails 366 or 370 with I cross-section 368 or T cross-section 372 may not be as desirable. Normally, rails 366, 370 with I and T cross-sections 368, 372 are easy to obtain and offer features that a vehicle could grasp rendering them popular with monorails. However, in apparatus with long unsupported spans of guide rail, such cross-sections are not as desirable due to their low torsional stiffness and resulting susceptibility to low frequency mechanical resonance modes.

Figure 8:
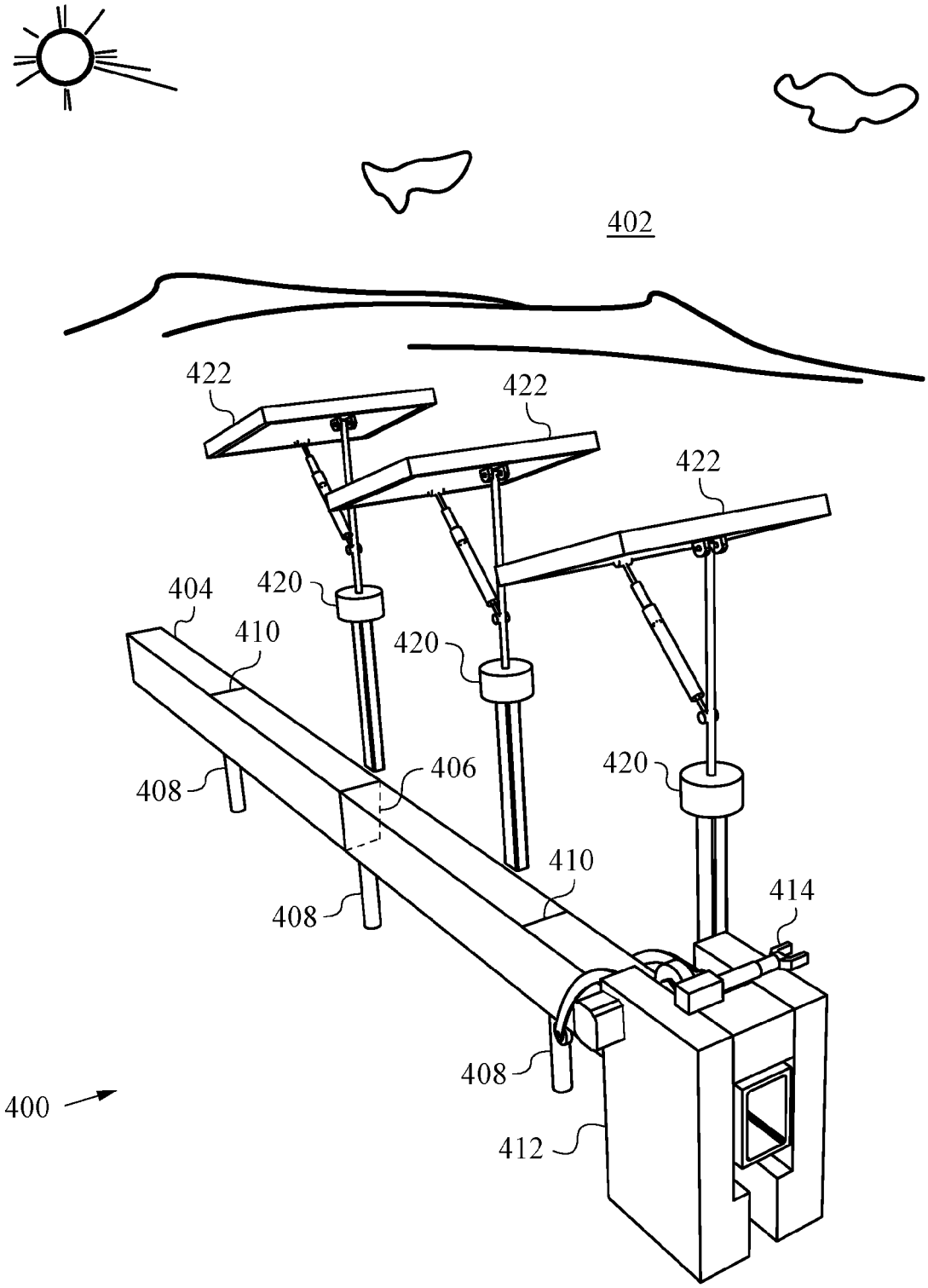
FIG. 8 is a perspective view of a monorail vehicle apparatus deployed to adjust mechanisms at docking locations in an outdoor environment.

FIG. 8 offers a perspective view of a monorail vehicle apparatus 400 deployed in accordance with the method of invention in an outdoor environment 402. Apparatus 400 uses a low-cost, non-featured rail 404 made of steel and having a rectangular cross-section 406. Rail 404 is suspended above the ground on posts 408 and has provisions 410 such as alignment data or other arrangements generally indicated on rail 404 for accurate positioning of a monorail vehicle 412 traveling on it.

Provisions 410 correspond to the locations of associated docking stations and are designed to accurately locate vehicle 412 at each one. Mechanical adjustment interfaces 420 for changing the orientation of corresponding solar panels 422 are present at each docking station. Further, vehicle 412 has a robotic component 414 for engaging with the interfaces 420 and performing adjustments to the orientation of solar panels 422.

In accordance with the invention, vehicle 412 is agile and can accelerate and decelerate rapidly. Hence, it can move rapidly between adjustment interfaces 420 on relatively long unsupported spans of low-cost rail 404 with rectangular cross-section 406 exhibiting substantial profile variation (as may be further exacerbated by conditions in outdoor environment 402, such as thermal gradients). These advantageous aspects of the invention thus permit rapid and low-cost operation of a solar farm while implementing frequent adjustments in response to changing insolation conditions.

Figure 9:
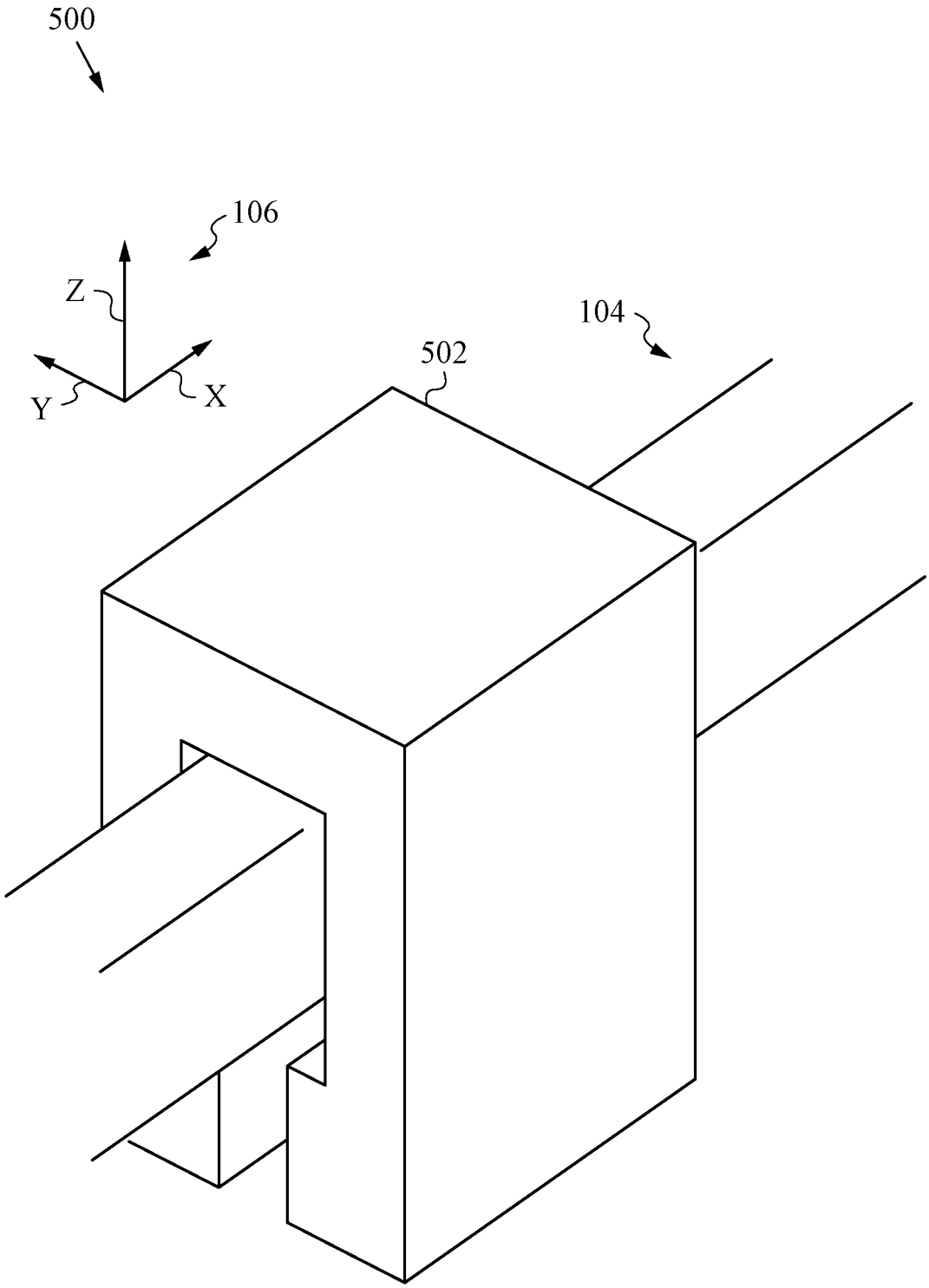
FIG. 9 is a partial isometric view of the monorail vehicle apparatus according to the invention that does not use any additional structures or assemblies to slide over the guide rail.

FIG. 9 shows another preferred embodiment of the present invention that does not require first and second assemblies. In other words, the monorail vehicle 502 of the present invention comprises a hollow cross section that simply slides over guide rail 104 of our previous embodiments.

Figure 10:
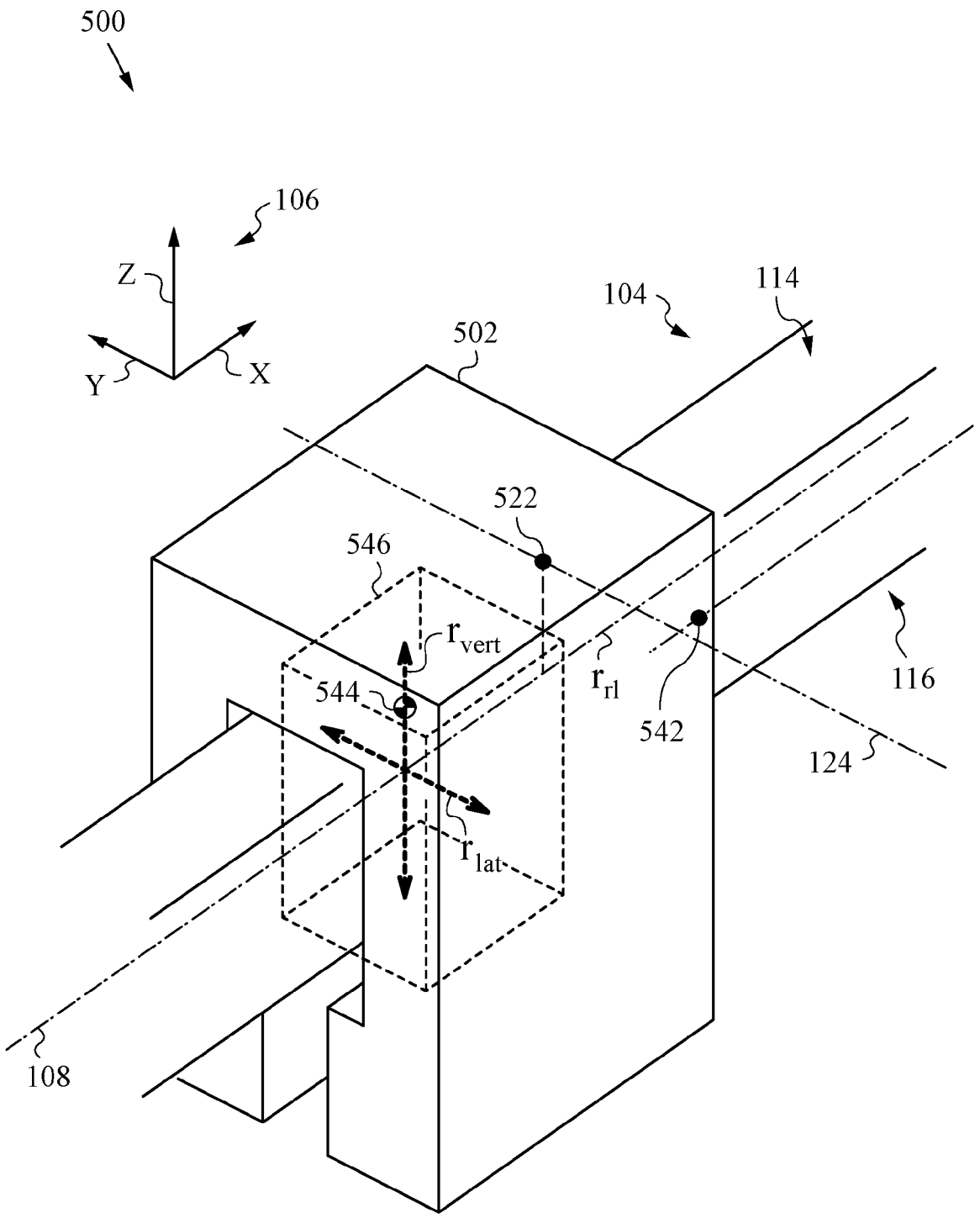
FIG. 10 shows the center of gravity and the various offsets of the monorail vehicle of the embodiment illustrated in FIG. 9.

FIG. 10 is a partial isometric view of monorail vehicle apparatus 500 of FIG. 9 that illustrates the full freedom in the placement of center of gravity 544 of vehicle 502 within volume 546 according to above teachings. The drawing shows pivot location 522 on bearing surface 114 and constraint point 542 on contact surface 116. Note while pivot location 522 and constraint point 542 may appear to be in the body of monorail vehicle 502 in this three dimensional view, they are intended to be on the top or bearing surface 114 and on the bottom or contact surface 116 respectively of rail 104 where monorail vehicle 502 defines its pivot location and constraint according to preceding explanation. The drawing also shows the rear longitudinal offset $r_{rl}$ from pivot location 522 and lateral offset $r_{lat}$ from center of gravity 544 in the Y-Z plane and along the Y-axis as defined in coordinate system 106. Lateral offset $r_{lat}$ is defined from rail centerline 108 along which rail 104 extends. As in previous embodiments, this degree of freedom in the placement of center of gravity 544 can be useful when vehicle 502 is not symmetric in its lateral weight distribution and for other engineering reasons.

Similarly, center of gravity 544 has a vertical offset $r_{vert}$ from rail centerline 108. Vertical offset $r_{vert}$ is also in the Y-Z plane and along the Z-axis as defined in coordinate system 106. In principle, vertical offset $r_{vert}$ can be set above rail centerline 108 or below it with the corresponding pros and cons taught above.

While the principles of the instant invention fully apply to embodiments where there are no other attachments or assemblies facilitating the mounting of monorail vehicle 502 over guide rail 104 and there are conceivable applications of such embodiments within the scope of the invention, a variety of practical applications will require monorail vehicle 502 to have wheels to counter friction and facilitate its motion along guide rail 104. Alternatively, referring still to FIG. 10, it is conceivable for the instant invention to merely have protuberances or other suitable features for defining pivot location 522 and constraint point 542 on bearing surface 114 and contact surface 116 respectively. Such features will reduce friction as monorail vehicle 502 translates along guide rail 104 as will be apparent to people of skill.

Figure 11:
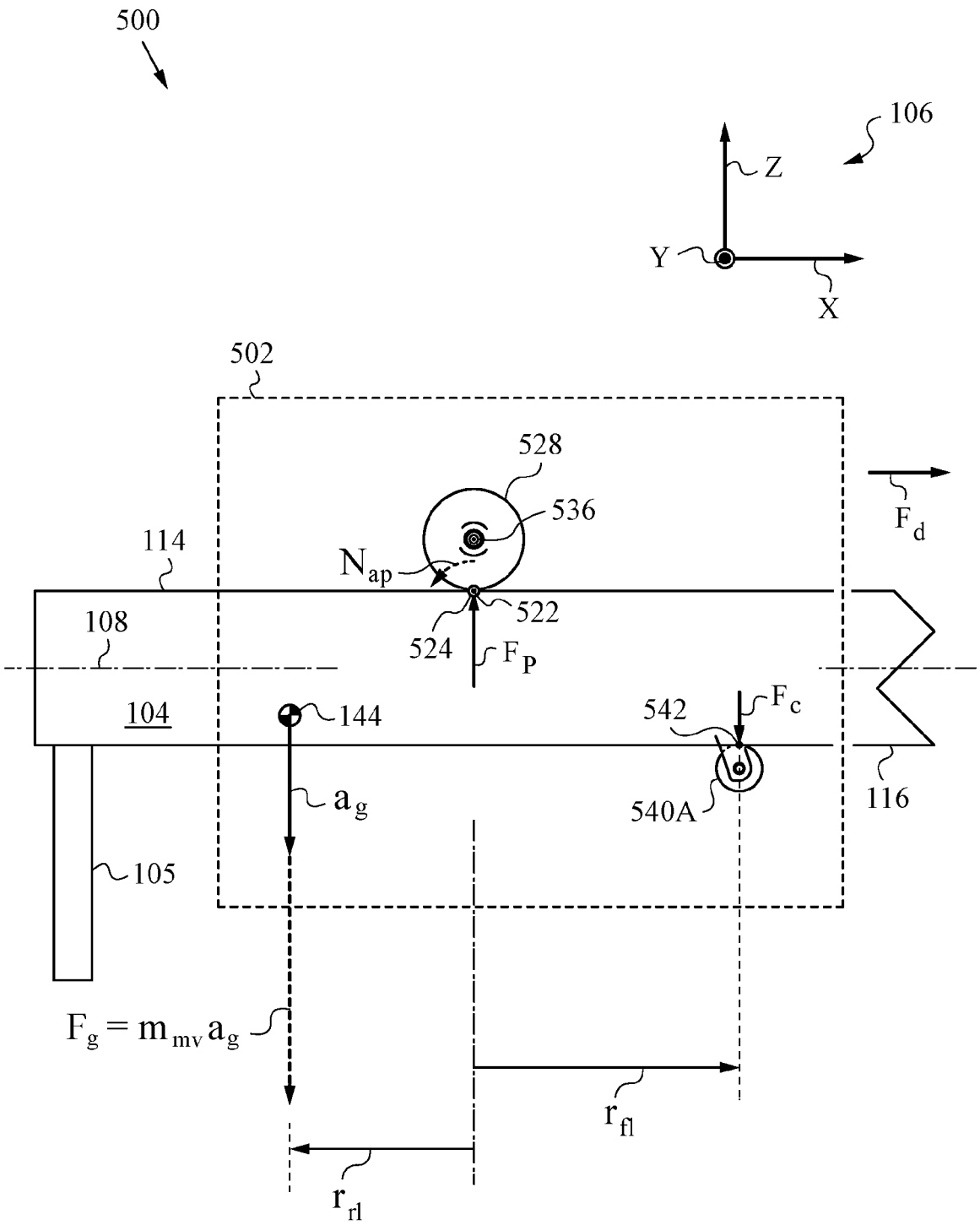
FIG. 11 is partial elevation view of a variation of the monorail vehicle of FIG. 9 that encapsulates a drive wheel and idler wheels.

FIG. 11 shows a partial elevation view of a similar embodiment of monorail vehicle apparatus 500 having a monorail vehicle 502 that has wheels to overcome friction and facilitate its motion along guide rail 104. Specifically, monorail vehicle 502 has a drive wheel 528 against bearing surface 114 to propel it along guide rail 104 and idler wheels 540A, 540B (note that only idler wheel 540A is visible in FIG. 11) against contact surface 116. Here, pivot location 522 and contact force $F_c$ against bottom or contact surface 116 of rail 104 are shown explicitly. More precisely, contact force $F_c$ obtains a constraint point 542 between idler wheels 540A, 540B and contact surface 116 at front longitudinal offset $r_{fl}$ from pivot location 522. Note the motor or drive mechanism responsible for translating monorail vehicle along rail 104 by rotating drive wheel 528 around rotation axis 536 is not shown in FIG. 11. Note also that alternate drive mechanisms for propelling monorail vehicle 502 in this embodiment are entirely possible within the scope of the invention and are not delved into detail further. Finally also note, that such an embodiment of the present invention may encapsulate additional idler and drive wheels against either bearing surface 114, contact surface 116 or both, to provide requisite propulsion and stability to monorail vehicle 502.

In accordance with the invention, monorail vehicle 502 is designed for producing a gravity-augmented normal load on drive wheel 528 and on idler wheels 540A, 540B. This objective is achieved by a judicious placement of center of gravity 544 of vehicle 502. Specifically, vehicle 502 has its center of gravity 544 offset longitudinally by $r_{rl}$ from pivot location 522. Such placement of center of gravity 544 produces a moment $N_{ap}$ about pivot location 522 or rather about pitch axis 524 and thus generates the desired gravity-augmented preload at pivot location 522 and at constraint point 542. As the value of rear longitudinal offset $r_{rl}$ increases, the normal load can be increased much beyond a standard normal load generated by the mass of monorail vehicle 502 alone.

Let us look at the requirement for a large normal load $F_p$ that is generated in accordance with the invention. $F_p$ is a force parallel with gravity vector $F_g$ shown acting on center of gravity 544. Furthermore, the force of normal load $F_p$ is experienced by drive wheel 528 contained in monorail vehicle 502. As the mass of monorail vehicle 502 increases, a drive force $F_d$ (indicated by its vector in FIG. 11) needed to accelerate it increases proportionately. Under ideal conditions, based on Newton's Second Law, the acceleration $a_{mv}$ of monorail vehicle 502 of mass $m_{mv}$ achieved by the application of drive force $F_d$ is governed by Eq. 1 as explained above.

Further as explained above, in practice, rolling friction μ places an upper limit on drive force $F_d$ that can be applied to a drive wheel. That is because the available drive force $F_d$ is limited by the force of friction $F_r$ at impending slip between drive wheel 528 and rail 104, and more precisely between drive wheel 128 and bearing surface 114.

As per above teachings, by placing center of gravity 544 of vehicle 502 at a longitudinal offset $r_{rl}$ from pivot location 522 where drive wheel 528 contacts bearing surface 114, and by providing constrained idler wheels 540A, 540B, normal load $F_p$ on drive wheel 128 is no longer limited by the mass $m_{mv}$ of vehicle 502. This was taught above by simplifying the equations that result from performing a static balance of the forces in the vertical direction and a static moment balance about pitch axis 524 that passes through pivot point 522. It is seen that normal load $F_p$ on drive wheel 528 can be increased by manipulating the value of rear longitudinal offset $r_{rl}$ of center of gravity 544 from pivot location 522. As such, per the above teachings, we are directly led to the computation of gravitational force $F_g$ (Eq. 3), moment $N_{ap}$ (Eq. 4), contact force $F_c$ (Eq. 5) and load $F_p$ on drive wheel 528 (Eq. 6).

As explained earlier in reference to FIG. 1-3, the loading on drive wheel 128 is governed by a factor of $$1 + \frac{r_{rl}}{r_{fl}},$$

and since $$\frac{r_{rl}}{r_{fl}}$$

is nonnegative, this factor is clearly greater than one. This permits increasing the normal force $F_p$ on the drive wheel 128 to a theoretically arbitrary limit. However, the normal load $F_p$ on drive wheel 128 is generally limited by a number of practical factors as previously explained. It will be clear to a skilled artisan that suitable modifications to the above expressions using trigonometric relations allow this analysis to be generalized to a guide rail having a non-zero inclination angle (non-horizontal rail).

As in previous embodiments, it is also entirely conceivable in this embodiment to have the drive wheel propelling monorail vehicle 502 on contact surface 116 instead of bearing surface 114, or drive wheels propelling the vehicle on both surfaces, within the scope of the invention. Furthermore, the present embodiment will also function on a low-grade stock rail that exhibits substantial profile variation or lack of smoothness of surface. Such low-grade stock rail, whose surface finish does not require highly sophisticated manufacturing processes is inexpensive to produce and easier to obtain than the rails of prior art whose surface characteristic need to be more refined. This opens up the instant invention to a variety of additional industrial applications, including the operation of a mobile robot to align the orientation of solar panels in a solar farm (refer to FIG. 8 and associated explanation).

In view of the above teaching, a person skilled in the art will recognize that the apparatus and method of invention can be embodied in many different ways in addition to those described without departing from the spirit of the invention. Therefore, the scope of the invention should be judged in view of the appended claims and their legal equivalents.

We claim:

1. A monorail system producing gravity-augmented load on a drive wheel, comprising:

a) a rail having a bearing surface and a contact surface;

b) a monorail vehicle for traveling on said rail, said monorail vehicle having:

1) a structure defining a pivot location against the bearing surface;

2) a first assembly for engaging said rail at said pivot location with at least one drive wheel;

3) a second assembly for engaging said rail on said contact surface to produce a contact force at a point offset from the pivot location; and 4) a center of gravity offset from the pivot location on an opposite side of the pivot location from the second assembly, wherein the center of gravity produces a moment about the pivot location that is resisted by the second assembly to produce a gravity-augmented load that is greater than the gravity force of the mass of the monorail vehicle at rest.

2. The monorail system of claim 1, wherein said monorail vehicle has a drive wheel for propelling said monorail vehicle along said bearing surface of said rail.

3. The monorail system of claim 1, wherein said monorail vehicle has a drive wheel for propelling said monorail vehicle along said contact surface.

4. The system of claim 1, wherein said rail extends along a rail centerline and said point has a front longitudinal offset $r_{fl}$ from said pivot location.

5. The monorail system of claim 1, wherein said rail extends along a rail centerline and said center of gravity has a lateral offset $r_{lat}$ from said rail centerline.

6. The monorail system of claim 1, wherein said rail extends along a rail centerline and said center of gravity has a vertical offset $r_{vert}$ below said rail centerline.

7. The monorail system of claim 1, wherein said center of gravity has a vertical offset $r_{vert}$ positioned to generate additional normal load when said monorail vehicle is accelerating or braking.

8. The monorail system of claim 1, wherein said rail is non-featured and has a predetermined cross-section extending along a rail centerline.

9. The monorail system of claim 1, wherein said bearing surface and said contact surface are geometrically opposite each other.

10. The monorail system of claim 1, wherein said rail further comprises an alignment datum for locating said monorail vehicle at a predetermined docking location.

11. A method for augmenting normal load by the placement of a center of gravity in a monorail vehicle traveling along a rail having a bearing surface and a contact surface, said method comprising:

a) mounting said monorail vehicle on said rail using a first assembly for engaging said rail at a pivot location against said bearing surface and a second assembly for engaging said rail on said contact surface to produce a contact force at a point offset from said pivot location; and b) placing said center of gravity of said monorail vehicle at a point offset from said pivot location on an opposite side of said pivot location from said second assembly, wherein said center of gravity produces a moment about the pivot location that is resisted by the second assembly to produce a gravity-augmented load that is greater than the gravity force of the mass of the monorail vehicle at rest.

12. The method of claim 11, further comprising:

a) providing said monorail vehicle with at least one wheel for engaging said bearing surface of said rail at said pivot location; and b) providing said monorail vehicle with at least one wheel for engaging said contact surface of said rail at said point offset from the pivot location.

13. The method of claim 12, wherein said at least one wheel for engaging said bearing surface of said rail is chosen to be a drive wheel for propelling said monorail vehicle along said rail.

14. The method of claim 12, wherein said at least one wheel for engaging said contact surface is chosen to be a drive wheel for propelling said monorail vehicle along said rail.

15. The method of claim 12, wherein said at least one wheel for engaging said bearing surface is chosen to be an idler wheel.

16. The method of claim 12, wherein said at least one wheel for engaging said contact surface is chosen to be an idler wheel.

17. The method of claim 11, wherein said rail extends along a rail centerline and said point has a front longitudinal offset $r_{fl}$ from said pivot location.

18. The method of claim 11, wherein said rail extends along a rail centerline and said center of gravity is placed at a lateral offset $r_{lat}$ from said rail centerline.

19. The method of claim 11, wherein said rail extends along a rail centerline and said center of gravity is placed at a vertical offset $r_{vert}$ below said rail centerline.

20. The method of claim 11, wherein said center of gravity is positioned at a vertical offset $r_{vert}$ to generate additional normal load when said monorail vehicle is accelerating or braking.

21. The method of claim 11, wherein said bearing surface and said contact surface are selected to be geometrically opposite surfaces of said rail.

22. The method of claim 11, wherein said rail is chosen to be non-featured and exhibits a predetermined cross-section extending along a rail centerline.

23. The method of claim 11, wherein said rail is chosen to be a low-grade stock rail that exhibits substantial profile variation.

24. The method of claim 11, further comprising providing an alignment datum for locating said monorail vehicle at a predetermined docking location.

* * * * *